US006608266B2

(12) United States Patent
Ford

(10) Patent No.: US 6,608,266 B2
(45) Date of Patent: Aug. 19, 2003

(54) PRESSURE SWITCH WITH ANNULAR ELECTRODES METHOD OF MAKING SAME

(75) Inventor: Greg E. Ford, Commerce, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/020,247

(22) Filed: Dec. 18, 2001

(65) Prior Publication Data

US 2003/0111326 A1 Jun. 19, 2003

(51) Int. Cl.[7] ..... H01H 35/34

(52) U.S. Cl. ..... 200/83 J; 200/83 R; 200/83 V; 29/622

(58) Field of Search ..... 29/622; 200/83 R, 200/83 B, 83 J, 83 P, 83 V

(56) References Cited

U.S. PATENT DOCUMENTS 2,698,887 A * 1/1955 Shaw ..... 200/83 V
2,827,526 A * 3/1958 Clason ..... 200/83 V
2,928,913 A * 3/1960 Dobrikin ..... 200/83 V
3,319,024 A * 5/1967 Quatredeniers ..... 200/83 V
3,600,601 A * 8/1971 Ayres ..... 307/118
3,789,949 A * 2/1974 Bortfeld et al. ..... 200/82 D
4,038,506 A * 7/1977 Filip ..... 200/83 J
5,728,986 A * 3/1998 Bennett et al. ..... 200/81.4

* cited by examiner

*Primary Examiner*—Michael Friedhofer
(74) *Attorney, Agent, or Firm*—Roger A. Johnston

(57) ABSTRACT

A pressure switch assembly has a cup-shaped piston slidable in a bore covered with an elastomeric diaphragm responsive to external pressure to move the piston. A pair of axially spaced ring electrodes have a flange on the piston disposed between the rings and moveable for making and breaking contact with one of the rings. A spring in the cup-shaped piston maintains electrical contact with the other of the pair of ring electrodes. Each ring electrode has a connector terminal preferably formed thereon.

14 Claims, 3 Drawing Sheets

PRESSURE SWITCH WITH ANNULAR ELECTRODES METHOD OF MAKING SAME

BACKGROUND OF THE INVENTION

The present invention relates to pressure switches of the type employed in fluid pressure actuated devices and particularly hydraulically actuated devices such as automatic power transmissions for motor vehicles.

In motor vehicle automatic power transmissions, it is desirable to provide electronically controlled shifting for the speed changes and where hydraulic actuators are employed for effecting movement of the clutches, it is necessary to provide an electrical signal to the controller when the hydraulic pressure in the shifting circuits reaches a predetermined level. Accordingly, it has been the practice to provide pressure switches in the hydraulic shifting circuits to close an electrical circuit to provide an electrical signal to the controller of the hydraulic fluid pressure in the particular actuator fluid circuit.

Known pressure switches for the aforesaid motor vehicle automatic power transmissions have suffered from the disadvantages of contact failure and erratic movement of the contact actuating mechanism in response to non-symmetric application of the fluid pressure forces to the switch actuator mechanism. This has been found particularly troublesome in pressure switches having an elastomeric diaphragm or boot covering the switch actuator piston mechanism; and, problems have been encountered in providing switch contacts which exhibited long service life and repeatable actuation points with respect to movement of the switch actuator in response to changes in the sensed hydraulic fluid pressure.

Asymmetric movement of the actuator mechanism in the known pressure switches resulting from fluid pressure acting on the diaphragm or membrane has resulted in improper contact making and breaking within the switch and erratic switch operation which effects the electronic control of the transmission shifting.

Thus, it has been desired to provide a way or means of designing and fabricating a pressure switch suitable for extended service life in a motor vehicle power transmission and which maintains its calibration over the vehicle service life and provides for long contact life within the switch.

BRIEF SUMMARY OF THE INVENTION

The present invention provides a diaphragm or boot operated pressure switch particularly suitable for sensing hydraulic pressure in a motor vehicle power transmission and which employs a piston centrally contacting the diaphragm with annular electrode contacts within the switch which are contacted by an annular flange provided on the piston. A flexible electrical conductor, preferably a helical wire spring provides continuous connection between the piston and one of the stationary annular contacts. Each of the stationary annular contacts has an electrical terminal extending therefrom and which is preferably formed integrally therewith. In the preferred practice, the annular electrodes are imbedded in molded plastic body members.

DETAILED DESCRIPTION OF THE INVENTION

Figure 1:
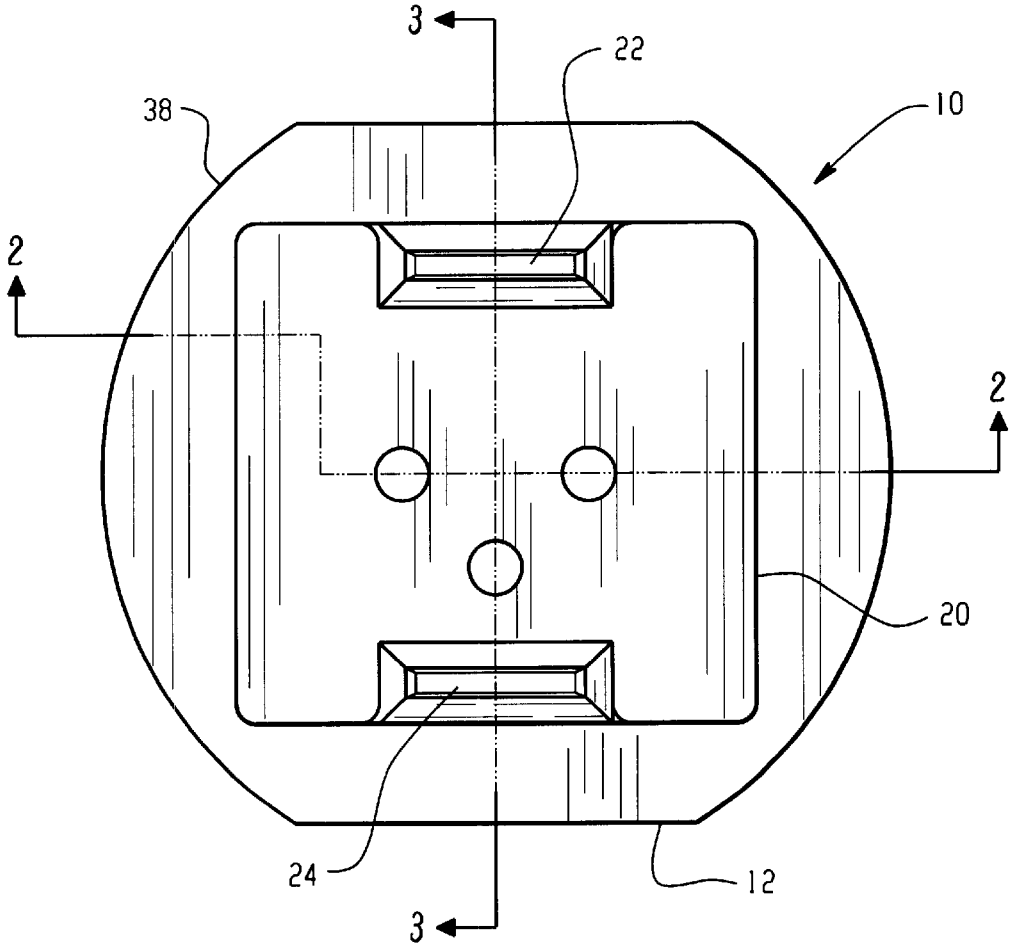
FIG. 1 is a top view of the pressure switch of the present invention.
Figure 2:
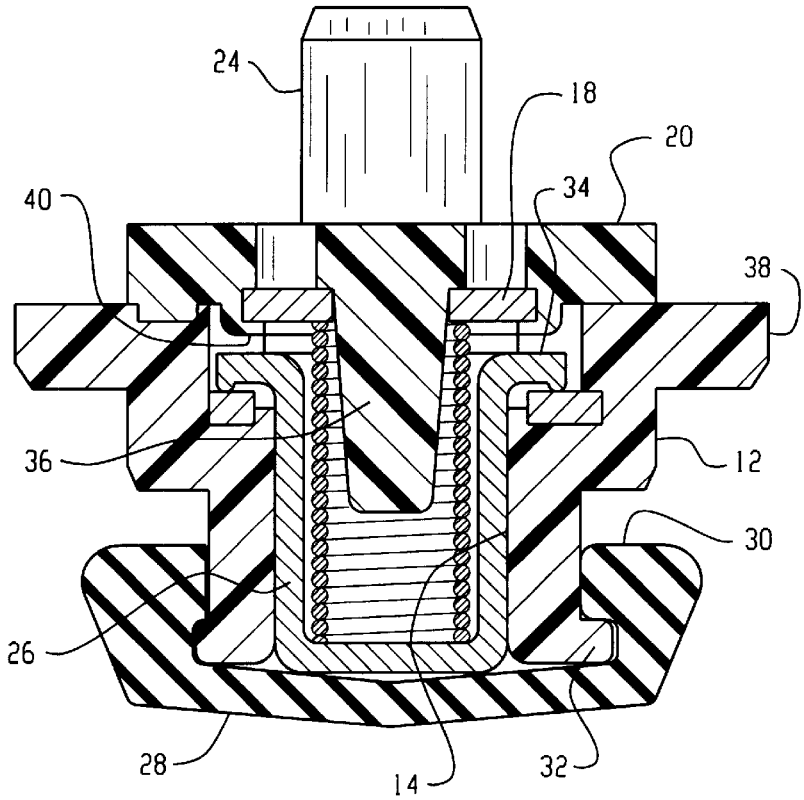
FIG. 2 is a section view taken along staggered section indicating line 2—2 of FIG. 1.
Figure 3:
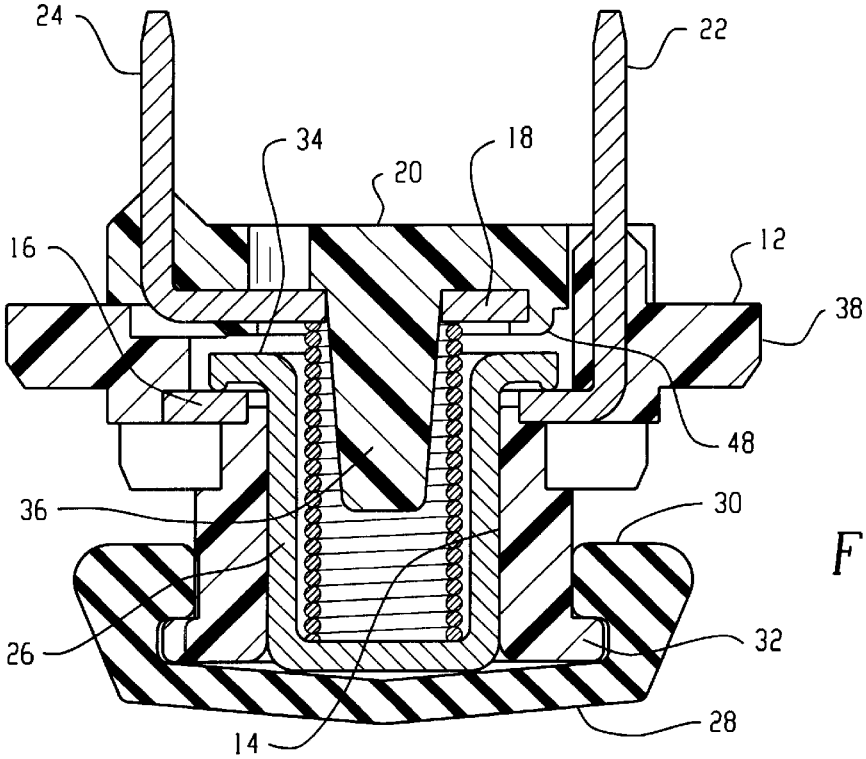
FIG. 3 is a section view taken along section indicating line 3—3 of FIG. 1; and, FIG. 4 is a an exploded view of an embodiment of the pressure switch assembly of the present invention.
Figure 4:
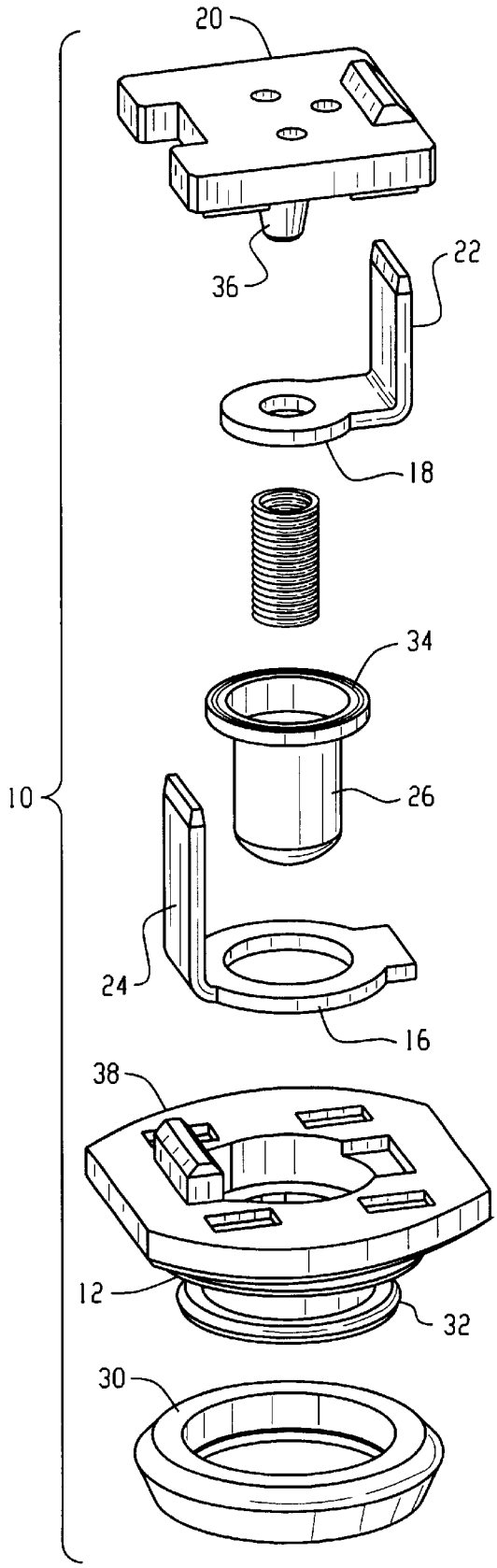

Referring to FIGS. 1 through 3, the pressure switch of the present invention is indicated generally at 10 and includes a base or housing member 12 with a piston bore 14 formed therein having a first stationary annular electrode 16 disposed therein with the inner periphery thereof surrounding bore 14. A second annular electrode 18 is disposed in axially spaced arrangement with the first electrode 16 and is preferably located and secured therein by a cover member 20 which is attached to and secured on the base 12.

Each of the annular electrodes 16, 18 has a connector terminal extending therefrom and preferably in an axial direction and preferably integrally formed therewith as denoted respectively by the reference numerals 22, 24. The terminals extend outwardly from the cover 20 as shown in FIGS. 2 and 3. Each of the annular electrodes 16, 18 may have non-conductive material molded thereabout to form respectively cover 20 and base 12 which may be joined by welding.

Referring to FIGS. 2 and 3, a piston 26 is slidably received in the bore 14 with the end thereof in contact with a boot or membrane 28 which is preferably formed of elastomeric material and which has a radially inwardly extending flange 30 formed about the outer periphery thereof which is received over a corresponding radially outwardly extending flange 32 formed about the lower end of the body 12 to thereby provide fluid pressure sealing isolation of the piston 26 and bore 14 from externally applied fluid pressure.

The piston 26, preferably has a cup-shaped configuration with an annular outwardly extending flange 34 formed about the open end thereof with the flange received axially between the stationary annular electrodes 16, 18.

A resiliently flexible electrical conductor 26 preferably in the form of a helical member or coil spring, is received within the cup-shaped piston with one end thereof in contact with the closed end of the piston and the opposite end of the flexible conductor in continuous contact with one of the annular electrodes 16, 18. In the presently preferred practice of the invention the helical conductor 26 biases the piston in a direction outwardly or against the diaphragm 28 and causes the moveable flange 34 to contact the stationary annular electrode 16 when the diaphragm 28 is not exposed to fluid pressure. In the presently preferred practice the helical conductor 26 comprises a spring and may also employ the calibration actuation point of the switch.

In the presently preferred practice of the invention, the cover member 20 includes a pilot portion 36 extending within the helical conductor 26 to provide centering of the helical conductor on the stationary annular electrode 18.

The body 12 has an outwardly extending mounting flange 38 preferably formed integrally thereon which is adapted to be mounted over an access opening in the hydraulically operated device for which pressure is to be sensed (not shown) and sealed thereover such that the diaphragm 28 is exposed to the fluid pressure in the device (not shown) to be hydraulically operated.

In operation, as the sensed fluid pressure is applied to the diaphragm 28, the pressure forces thereof are accumulated and applied by the diaphragm 28 to the piston 26 overcoming the bias of the helical member 26 and causing the piston to move inwardly breaking the contact of the moveable flange 34 with the stationary annular conductor 16. Continued increasing pressure on the diaphragm causes further movement of the piston, in the form of over-travel, until the annular flange 34 makes contact with the stationary electrode 18 or with the over-mold portion 40 of the cover which in the presently preferred practice of the invention is employed to retain the annular electrode 18 thereon.

The.present invention thus provides a unique and relatively low cost assembly for a pressure switch suitable for sensing hydraulic pressure in a motor vehicle power transmission which provides reliable symmetric actuation of annular contacts within the switch and which is capable of maintaining accurate calibration and repeatability over an extended service life.

Although the invention has hereinabove been described with respect to the illustrated embodiments, it will be understood that the invention is capable of modification and variation and is limited only by the following claims.

What is claimed is:

1. A pressure switch assembly for exposure to pressurized fluid comprising:

(a) a body having a first stationary annular electrode disposed therein, said first stationary annular electrode having integrally formed therewith a first connector terminal extending therefrom and externally of the body;

(b) a second stationary annular electrode disposed on said body and spaced from said first annular electrode, said second annular electrode having integrally formed therewith a second connector terminal extending therefrom and externally of the body;

(c) a moveable member including an annular contact disposed between said first and second annular electrodes, said moveable member guided for sliding movement on said body;

(d) a resiliently flexible conductor having one end thereof continuously contacting said moveable member and an end distal said one end continuously contacting one of said first and second stationary annular electrodes; and, (e) a flexible seal disposed to provide fluid pressure sealing of said sliding movement of said moveable member, wherein said annular contact is in contact with said other of said first and second stationary annular electrodes when the flexible seal is exposed to a fluid pressure less than a certain level thereby providing electrical connection between said first and second stationary annular electrodes, and said contact of said annular contact with said one of said first and second stationary annular electrodes is broken when the flexible seal is exposed to a fluid pressure at and above said certain level, wherein said first and second annular electrodes have non-conductive material molded thereabout for forming a base and cover which are joined to form said switch body.

2. The switch assembly defined in claim 1, wherein said resiliently flexible conductor comprises a coil spring.

3. The switch assembly defined in claim 1, wherein said moveable member has a cup-shaped configuration and said annular contact comprises an outwardly extending flange about a rim of the cup-shape.

4. The switch assembly defined in claim 3, wherein said outwardly extending flange is formed integrally with the cup-shaped moveable member as a one-piece member.

5. The switch assembly defined in claim 1, wherein said resiliently flexible conductor biases said moveable member in a direction closing said annular contact against said other of said first and second electrode.

6. The switch assembly defined in claim 1, wherein said moveable annular contact comprises an annular flange about a rim of a cup-shaped member and said resiliently flexible conductor comprises a coil spring nested in the cup-shaped member.

7. A method of making a pressure switch comprising:

(a) providing a conductive piston with an outwardly extending flange;

(b) disposing the piston for sliding movement in a switch body;

(c) forming a first and second annular conductor each with a terminal extending therefrom and disposing the first and second annular conductors in axially spaced relationship on the body and disposing said flange between said first and second annular conductor;

(d) electrically connecting one of said first and second annular conductors and said piston with a resiliently flexible conductor;

(e) sealing about said piston in said body with a moveable fluid pressure seal;

(f) biasing said piston in a direction causing said flange to make contact with the other of said first and second annular electrodes and to break the contact when said piston is exposed to a certain fluid pressure; and, (g) molding non-conductive material about said first and second annular conductors and forming a base and cover and joining said base and cover to form said body.

8. The method defined in claim 7, wherein said step of electrically connecting includes disposing a helically coiled member.

9. The method defined in claim 7, wherein said step of biasing includes forming said resiliently flexible conductor as a spring.

10. The method defined in claim 7, wherein said step of joining includes welding.

11. The method defined in claim 7, wherein said step of forming said first and second annular electrodes includes forming the terminals extending therefrom integrally therewith.

12. The method defined in claim 7, wherein said step of providing said piston includes forming a cup-shaped member.

13. The method defined in claim 12, wherein said step of forming said cup-shaped member includes forming integrally therewith the annular outwardly extending flange.

14. The method defined in claim 7, wherein said step of forming said first and second annular electrodes includes forming the terminals extending therefrom in an axial direction.

* * * * *